United States Patent [19]

Holcomb

[11] 4,142,337

[45] Mar. 6, 1979

[54] HYDROTHERAPY SPA AND METHOD OF FABRICATING SAME

[76] Inventor: Ben W. Holcomb, 3871 Bartley Dr., Sacramento, Calif. 95822

[21] Appl. No.: 801,476

[22] Filed: May 31, 1977

[51] Int. Cl.[2] ..... E04H 3/18

[52] U.S. Cl. ..... 52/169.7; 52/742; 264/35; 4/172.21

[58] Field of Search ..... 52/309.1, 181, 742, 52/169.7; 4/172.21, 146, 185 R; 404/47; 264/35

[56] References Cited

U.S. PATENT DOCUMENTS

| | | | |
|---|---|---|---|
| 2,757,385 | 8/1956 | Whittick | 4/146 |
| 2,887,759 | 5/1959 | Brownell | 52/742 |
| 3,015,191 | 1/1962 | Lucchesi | 52/169.7 |
| 3,397,494 | 8/1968 | Waring | 264/35 |
| 3,572,225 | 3/1971 | Burton | 404/47 |
| 4,060,946 | 12/1977 | Lang et al. | 52/742 |

FOREIGN PATENT DOCUMENTS

| | | | |
|---|---|---|---|
| 1467992 | 12/1966 | France | 52/169.7 |

OTHER PUBLICATIONS

Adelbert P. Mills, Harrison W. Hayward, Lloyd F. Rader, Materials of Construction, John Wiley and Sons, New York, 1955, Sixth Ed., pp. 419 and 420.

Modern Plastics, Jan., 1952, pp. 96 & 97.

*Primary Examiner*—James L. Ridgill, Jr.

*Attorney, Agent, or Firm*—Lothrop & West

[57] ABSTRACT

Resin is sprayed onto the inside of a mold. Fiberglass is then applied to the resin to form a shell having a bottom, side walls and an upper, outwardly turned lip. The fiberglass forms a somewhat roughened surface on the inner side of the completed shell, thereby eliminating the cracking and chipping of the inner surface which has heretofore occured when the fiberglass was on the outer side of the shell and the inner surface of the shell was smooth resin.

After the required plumbing is mounted on the shell, the shell can be installed at the desired location, usually in the ground and frequently near a swimming pool.

A hole is formed in the ground somewhat larger than the shell and at least three stakes of appropriate length are driven into the bottom of the hole, adjacent the periphery thereof, to a depth such that the upper ends of the stakes coincide with the desired height of the lip of the shell. The shell is then lowered into the hole so that the lip rests on the stakes for support of the shell. At this juncture the hole around the shell is filled with concrete grout which ultimately hardens in order rigidly to set the resulting spa into the ground but which initially is in a semi-liquid state. During the time the grout is semi-liquid it exerts an upward buoyant force on the bottom of the shell, thereby urging the shell upwardly. Pursuant to the method of the present invention the shell is filled with water as the grout is added at a rate such that the weight of the water slightly exceeds the upward force of the grout, thereby maintaining the shell in supporting engagement with the stakes and thus establishing accurate grade and avoiding tilt. Anchors may also be provided on the bottom of the shell, in which case a hardening accelerator, such as calcium chloride, is added to the initial charges of grout until the level of the grout is above the anchors. The accelerator causes the grout to harden and grip the anchors, thus securing the shell in place quickly.

6 Claims, 4 Drawing Figures

11
12
13
14
15
16
17
18
19
20
21
22
23
29
30
31
32
33
34
36
37
38
39
41

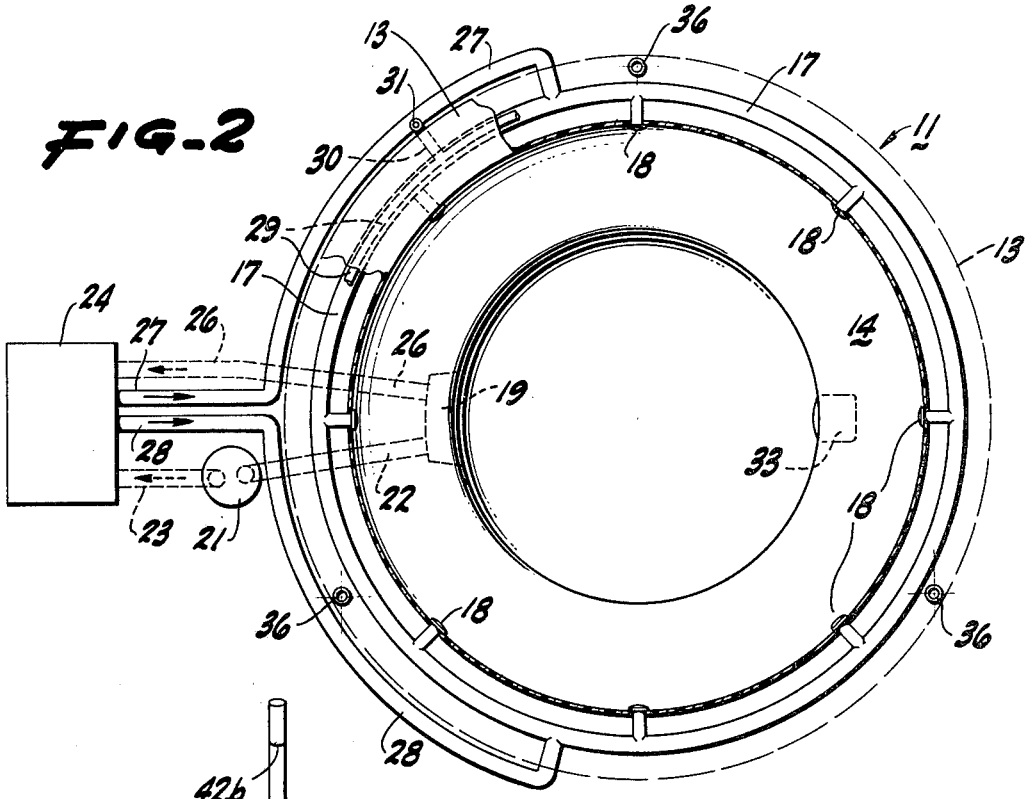
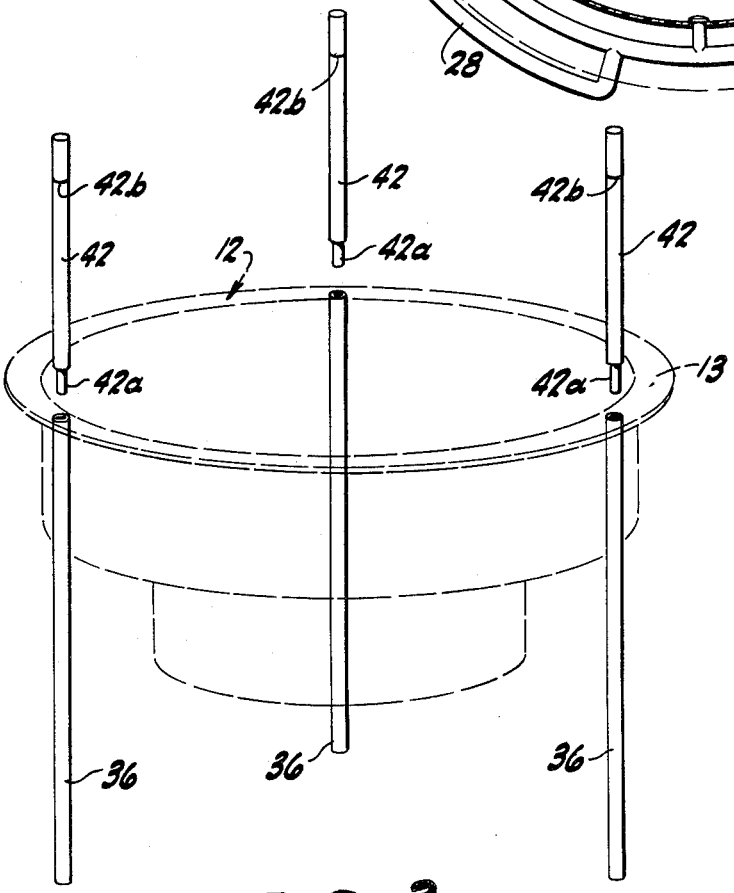
FIG-3
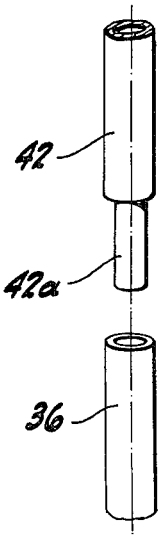
FIG-4

HYDROTHERAPY SPA AND METHOD OF FABRICATING SAME

BACKGROUND OF THE INVENTION

Hydrotherapy spas are becoming increasingly popular. In addition to the pleasurable and relaxing sensation of being immersed in swirling hot water, the spas provide therapeutic benefits, such as relief from tension and sore muscles. Spas may be constructed either indoors or outdoors either by themselves or in conjunction with swimming pools.

These spas generally comprise a fiberglass shell which is on the order of 6–8 feet across and 3–4 feet deep in a round, square, hexagonal or other shape. A plurality of jet nozzles is spaced around the periphery of the shell below the water line to inject jets of aerated warm or hot water into the spa, forming swirls and eddies which provide comfort and relaxation to the bather.

Shells have heretofore conventionally been constructed by spraying liquid epoxy or other suitable resin onto the outer surface of a mold. Glass fibers are then applied to the resin and embedded therein. After the resin hardens, the shell is removed from the mold, with the inner resin or gel surface constituting the inner finished surface of the shell. Although this construction provides an inner surface initially smooth and aesthetic in appearance, the smooth resin tends over a period of time to form hairline cracks which trap dirt and detract from the appearance of the spa.

Another problem has heretofore remained unsolved in the fabrication of the spa. In the past, a hole was dug in the ground somewhat larger than the shell and its plumbing, and the shell lowered into the hole. With the shell in place, grout was pumped into the hole. Even if the shell was initially placed in the hole at the correct elevation and with no tilt, the added grout exerted an upward buoyant force on the shell which pushes the same above its desired position. Once the grout hardened, the situation could not be corrected without excessive effort. Attempts to compensate for this effect by positioning the shell lower in the hole so that the grout floated the shell upwardly to its desired position produced results which were less than satisfactory, frequently resulting in a tilted spa or a spa located above or below grade.

SUMMARY OF THE INVENTION

The present invention relates to an improved hydrotherapy spa and method of fabricating the same.

The problem of hairline cracking on the inner of finished surface of the spa is eliminated by forming the shell on the inside rather than the outside of the mold and in a sequence such that the fiberglass is embedded in the resin at the exposed surface.

The problem of positioning the shell in the hole at the desired height and without tilt is solved by providing an out-turned lip on the upper end of the shell and driving three of more supporting stakes into the bottom of the hole with the upper ends of the stakes corresponding to the desired height of the upper lip of the shell. The shell is placed into the hole so that the lip rests on the stakes, thereby supporting the shell at the desired grade. As the grout is pumped into the hole, the shell is filled with water at a rate such that the weight of the water just overcomes the upward force of the grout, thereby maintaining the shell at its correct position on the stakes until the grout has completely hardened.

It is an object of the invention to provide an improved hydrotherapy spa including means for accurately and expeditiously installing it in the ground.

It is another object of the invention to provide a spa, the inner surface of which will not crack with age.

It is another object of the invention to provide a method of fabricating a spa which results in a strong and durable installation.

It is another object of the invention to provide a method of fabricating a spa which is quick and relatively economical.

It is another object of the present invention to provide a generally improved hydrotherapy spa and method of fabricating the same.

Other objects, together with the foregoing, are attained in the embodiment described in the following description and illustrated in the accompanying drawing.

BRIEF DESCRIPTION OF THE DRAWING

FIG. 2 is a top plan view of the spa with the lip removed yet indicating the outline of the lip in broken line;

FIG. 3 is a simplified perspective view showing three supporting stakes being installed in the ground with the help of three extensions which can be fitted to the stakes for levelling and which are removed before the shell (shown in phantom) is placed on the stakes; and, FIG. 4 is a fragmentary exploded view of one of the stakes and the respective extension.

DESCRIPTION OF THE PREFERRED EMBODIMENT

Figure 1:
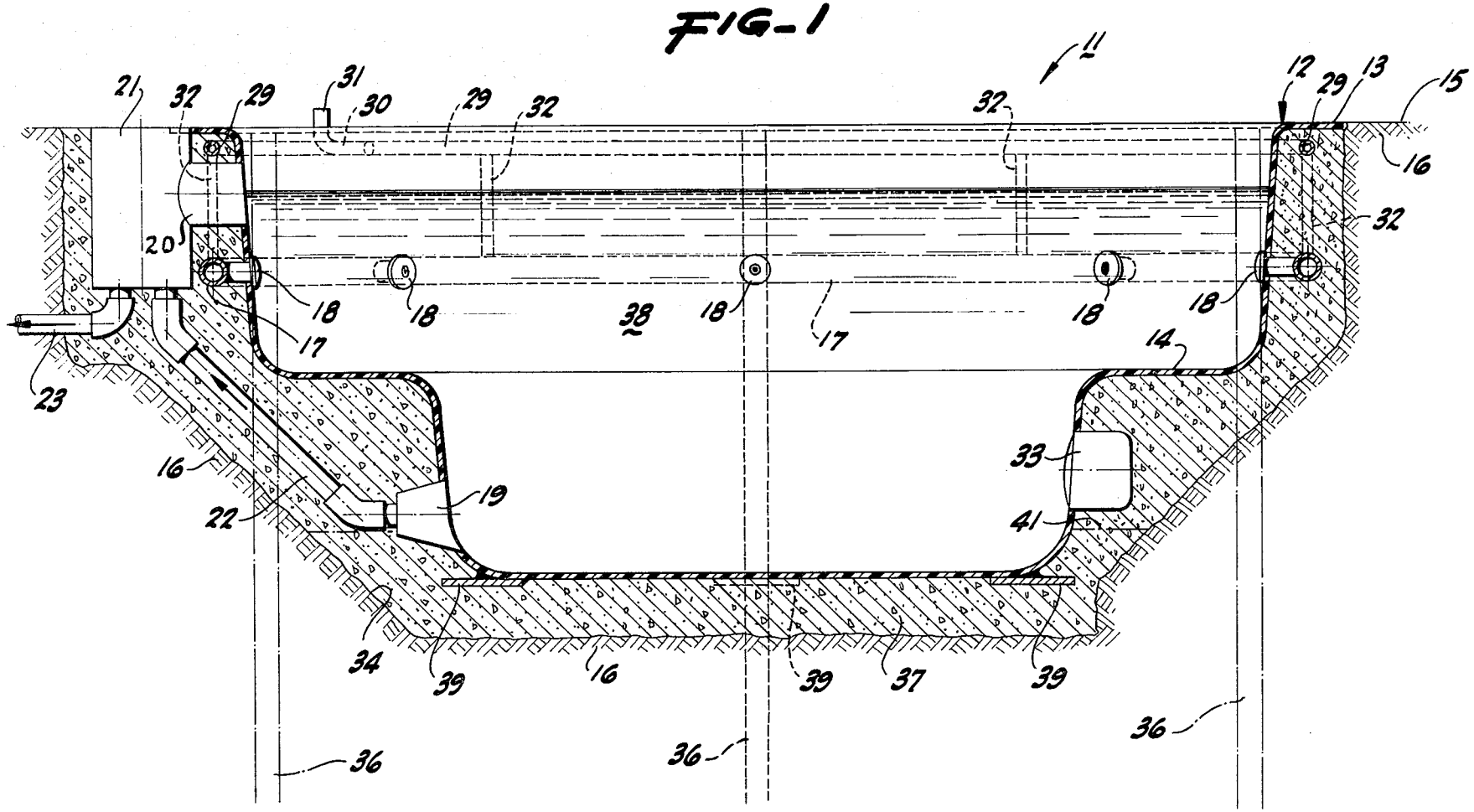
FIG. 1 is a side elevational view, with portions in section, of a hydrotherapy spa embodying the present invention.

While the hydrotherapy spa of the invention is susceptible of numerous physical embodiments, depending upon the environment and requirements of use, substantial numbers of the herein shown and described embodiments have been made, tested and used, and all have performed in an eminently satisfactory manner.

With particular reference to FIGS. 1 and 2 of the drawings, a hydrotherapy spa 11 embodying the present invention comprises a tub or vat-shaped liner 12, or shell formed with an annular, outwardly-turned upper lip 13. The shell 12 is fabricated by shooting or spraying a liquid resin, such as an epoxy, onto the inside of a mold (not shown) and then embedding glass fibers into the surface of the resin. When the resin hardens, the shell 12 becomes rigid and is removed from the mold. The glass fibers at the inner surface of the shell 12, in addition to increasing the strength of the shell 12, prevent hairline cracks from forming at the inner or finished surface of the shell 12 which frequently occur when shells are formed with the fiberglass at the outer or unfinished surface thereof. The exposed fiberglass surface is slightly rough and therefore provides safe footing.

The lower portion of the shell 12 is frequently made smaller in diameter than the upper portion thereof to form a circular bench 14 on which bathers may sit comfortably while immersed in the water in the spa 11.

The spa 11 may be set in the ground 16 so that the upper lip 13 of the shell 12 is substantially flush with the ground surface grade 15, or level. The spa 11 may alternatively be positioned so that the lip 13 is above ground level 15 to provide another seat or to match an above-ground decking (not shown).

A drain 19 is provided near the bottom of the shell 12, the drain leading upwardly into a skimmer 21 through a drain pipe 22. As shown in FIG. 1, a conventional skimmer throat 20 located at water level connects the spa surface with the skimmer 21.

Both the drain pipe 22 and a main suction pipe 23 open into the skimmer 21 through the bottom thereof, with the main suction pipe 23 leading to the inlet of a pump 24. An auxiliary suction pipe 26 (see FIG. 2) leads directly from the drain 19 to the inlet of the pump 24. Two return pipes 27 and 28 lead from the outlet of the pump 24 to opposite sides of a header pipe 17 which is in the form of a tubular ring encircling and attached to the outside of the shell 12. The header pipe 17 opens into the interior of the shell 12 through jet nozzles 18 located below waterline between the bench 14 and the lip 13. The jet nozzles 18 are shown as being eight in number and are equally spaced about the periphery of the shell 12.

A tubular airline 29 is provided around the circumference of the shell 12 just below the lip 13 and opens to the atmosphere through a snorkel 30 which may include a connecting riser tube 31 removed somewhat from the spa to assure a free inflow of air. The airline 29 is connected to the leader pipe 17 through a plurality of venturi tubes 32. Preferably the airline 29 is above the waterline.

With the pump 24 energized, water is pumped from the shell 12 through the drain 19 and pipes 22, 23 and 26 and recirculated back into the shell 12 through the pipes 27 and 28, header pipe 17 and jet nozzles 18. The flow of water through the header pipe 17 sucks air into the header pipe 17 through the snorkel tube 30, airline 29 and venturi tubes 32 so that the water jets injected into the spa through the jet nozzles 18 are mixed with air bubbles. The resulting swirl produced by the water and air injected into the shell 12 through the jet nozzles 18 gives a relaxing and pleasant sensation to bathers in the spa 11 and also serves to reduce the discomfort of sore or fatigued muscles.

Although not shown, a heater may be provided to heat the water being circulated by the pump 24 to a comfortable temperature on the order of 105° F. The shell 12 is also preferably provided with a light niche 33 in which a light bulb (not shown) is disposed to illuminate the interior of the spa 11 for nighttime bathing. All of the plumbing with the exception of the pump 24 is securely fiberglassed or otherwise fixed to the shell 12 at the factory so that the shell 12 and attendant plumbing may be transported to and installed at the intended site as a substantially completed unit.

To install the shell 12 in the ground 16 and thereby complete the fabrication of the spa 11, a hole 34 is dug in the ground 16, the hole being made somewhat larger than the shell 12 and its plumbing. Three stakes 36 (more can be used if desired) are then driven into the bottom of the hole 34. The stakes 36 are conveniently made of suitable lengths of metal electrical conduit tubing. The stakes 36 are driven into the ground 16 so that the upper ends are at the desired height of the upper lip 13 of the shell 12 (at ground level in the illustrated example) with the shell 12 located in position in the hole 34. The stakes 36 are spaced around the periphery of the hole 34 so that the lip 13 of the shell 12 is supported on the tops of the stakes 36, as shown in broken line in FIG. 1, when the shell 12 is in the desired position in the hole 34. As best seen in FIG. 2, the stakes 36 are preferably located on a circle having a center corresponding to the center of the shell 12 and a radius slightly greater than that of the arcuate header pipe 17. If three stakes are used, they are usually equally circumferentially spaced 120° apart.

The stakes 36 should be driven into the ground 16 deep enough to engage bedrock or very solid soil, since they must temporarily support the shell 12 without being forced further into the ground 16 by the weight thereof. If solid soil is not encountered, additional stakes of greater length and, if necessary, greater diameter, may be required to provide the effect of piling.

With the stakes 36 driven into place, the shell 12 with affixed plumbing is lowered into the hole 34 so that the lip 13 rests on the stakes 36, the shell 12 being thereby supported by the stakes 36. Concrete grout 37 in the form of slurry is then pumped into the hole 34 around the shell 12. The grout 37 must be of moderately thin consistency in order to fill the irregularly shaped spaces between the shell 12, the wall of the hole 34, plumbing, etc. The grout 37 comprises, for example, cement, sand, asbestos and water in suitable proportions.

As the grout 37 rises it exerts an upward, positive buoyant force on the shell, thereby urging the shell upwardly off the stakes 36. In order to prevent the shell 12 from being lifted upwardly away from its desired position, the shell 12 is filled with water 38 at a rate such that the weight of the water 38 is just enough to overcome the upward force of the grout 37 on the shell 12. In this manner, the shell 12 is maintained in its proper position on the stakes 36 during the entire operation of pumping the grout 37 into the hole 34 and during the time the grout is allowed to harden. When the grout 37 is completely hardened, the resulting spa 11 is rigidly and securely set into the ground 16 in precisely the required position, at proper grade, or level, and without tilt.

The stakes 36, in addition to facilitating the fabrication of the spa 11, serve to support the shell 12 in conjunction with the concrete mass constituted by the hardened grout and even more firmly anchor the spa 11 in the ground 16.

As will be realized, although the stakes 36 are shown as supporting the lip 13 of the shell 12, they may be adapted to support the bottom or any other suitable portion of the shell.

In order further to expedite the fabrication of the spa 11, a plurality of horizontally extending anchors 39 is preferably fiberglassed to the bottom of the shell 12. When the initial portion of the grout 37 is pumped into the hole 34 i.e. up to a level 41 somewhat above the anchors 39, a hardening accelerator such as calcium chloride is added to the grout 37. The accelerator causes the grout 37 encasing the anchors 39 to harden quickly. Thus, with the shell 12 partially supported by the grout 37 and prevented from upward movement through encasement of the anchors 39, the rate of filling the shell 12 with water 38 may be either too fast or too slow within considerable limits without adversely affecting the fabrication of the spa 11.

For convenience in installing the stakes 36, extensions 42 may be detachably coupled to the stakes 36 as indicated in FIGS. 3 and 4.

The extensions 42 are preferably in the form of rods of a diameter on the order of the diameter of the stakes 36 but with lower ends **42*a* reduced to the diameter of the inner walls of the stakes 36 to enable the extensions to fit onto the stakes 36. In this manner, the extensions 42 may be easily attached to the stakes 36 and removed from time to time while the stakes 36 are driven into the ground. The extensions 42 are provided with sighting marks 42***b* at a convenient position so that the height of the sighting marks 42*b* and thereby the height of the upper ends of the stakes 36 relative to ground level and their distance from any reference point may be easily determined using conventional surveying techniques.

In summary, it will be seen that the present invention provides a hydrotherapy spa having an inner surface which will not crack and which is quickly, securely and precisely installed in the ground in such a manner as to give many years of pleasurable use.

What is claimed is:

1. A spa comprising:

a. a shell formed with a horizontal portion;

b. at least three ground engaging stakes supporting the horizontal portion of said shell;

c. a plurality of laterally projecting anchors mounted on the bottom of said shell; and, d. a concrete mass disposed in the ground below said shell and enclosing said stakes and said anchors.

2. A spa as in claim 1 in which the portion of said concrete mass enclosing said anchors includes a concrete hardening accelerator.

3. A spa as in claim 1 in which the shell is formed of resin and a fiberglass material embedded in the resin on the inner surface of the shell.

4. A spa as in claim 1 in which the horizontal portion of the shell is an upper lip thereof.

5. A method of fabricating a spa including a shell and a plurality of anchors on the bottom of the shell, said method comprising the steps of:

a. forming a hole in the ground larger than the shell;

b. driving at least three stakes into the hole so that the upper ends of the stakes are at a predetermined height in supporting relation to the shell;

c. placing the shell in the hole so that the shell rests on the stakes for support of the shell at an elevation determined by said stakes;

d. adding a hardening accelerator to a first portion of grout;

e. filling the hole around the shell with the first portion of grout only until the first portion of grout reaches a predetermined level above the bottom anchors;

f. filling the shell with water as the first portion of grout is added, the rate of filling being such that the weight of the water at least slightly exceeds the upward force of the grout and accelerator mixture on the shell in order to maintain the shell in supporting engagement with the stakes at least until the first portion of grout reaches the predetermined level;

g. continuing to fill the hole around the shell until full with a second portion of grout devoid of hardening accelerator; and, h. continuing to fill the shell with water during the addition of the grout, the rate of filling with water being such that the weight of the water is approximately on the order of the upward force of the grout on the shell.

6. A method of fabricating a spa as in claim 5 in which the shell includes an upper lip and in which step (b) includes driving the stakes into the ground so that the heights of the upper ends are level and substantially correspond to the desired height of the upper lip.

* * * * *